US006112490A

United States Patent [19]

Meyer

[11] Patent Number: 6,112,490

[45] Date of Patent: Sep. 5, 2000

[54] SPRAY INSULATION SHIELD APPARATUS AND APPLICATION METHOD

[76] Inventor: Donald L. Meyer, 105 Alvin St., East Peoria, Ill. 61611

[21] Appl. No.: 09/036,387

[22] Filed: Mar. 6, 1998

Related U.S. Application Data

[63] Continuation-in-part of application No. 08/812,034, Mar. 6, 1997, abandoned.

[51] Int. Cl.[7] ..... E04B 1/74

[52] U.S. Cl. ..... 52/407.3; 52/95; 52/317; 52/363; 52/404.3; 52/742.14

[58] Field of Search ..... 52/94, 95, 317, 52/344, 363, 404.1, 404.3, 407.1, 407.3, 407.4, 742.1, 742.13, 742.14

[56] References Cited

U.S. PATENT DOCUMENTS

| | | | |
|---|---|---|---|
| 2,172,048 | 9/1939 | Johnson . | |
| 2,788,552 | 4/1957 | Miles . | |
| 3,160,987 | 12/1964 | Pinkley . | |
| 3,246,438 | 4/1966 | Harting . | |
| 3,619,437 | 11/1971 | McDonald, Jr. . | |
| 3,863,553 | 2/1975 | Koontz | 52/95 X |
| 3,952,402 | 4/1976 | Mengeringhausen . | |
| 4,069,628 | 1/1978 | Kreimer | 52/94 |
| 4,125,982 | 11/1978 | Ward | 52/404.1 |
| 4,185,433 | 1/1980 | Cantrell | 52/94 |
| 4,189,878 | 2/1980 | Fitzgerald . | |
| 4,292,777 | 10/1981 | Story . | |
| 4,310,996 | 1/1982 | Mulvey et al. . | |
| 4,581,861 | 4/1986 | Eury | 52/95 |
| 4,696,138 | 9/1987 | Bullock . | |
| 4,724,651 | 2/1988 | Fligg . | |
| 5,007,216 | 4/1991 | Pearson | 52/94 |
| 5,655,350 | 8/1997 | Patton | 52/404.1 X |

*Primary Examiner*—Carl D. Friedman
*Assistant Examiner*—Kevin D. Wilkens
*Attorney, Agent, or Firm*—Amster, Rothstein & Ebenstein

[57] ABSTRACT

An insulation confining shield and application method, the shield mountable between elongated structural framing members in an unfinished wall or ceiling for insulation dispensed as curable liquid having a blowing agent or an insulation material with a curable adhesive, comprising: a sheet of elongated semi-rigid or rigid material having a center web section and a pair of opposed flanges extending substantially perpendicular from the center web section defining an insulation confining volume, the web section and the flanges being constructed and arranged to fit between the structural framing members in the wall or ceiling to retain the insulation when cured after being applied against the web section and the flanges, in one embodiment, the flanges having a plurality of vent apertures defined therethrough to enable a quantity of the insulation, when applied, to migrate from the insulation confining volume to an area outside of the confining volume and adhere to a portion of the structural framing members to mitigate heat transfer through the structural framing members, in another embodiment, the insulation confining shield being positioned relative to the structural framing members and having larger vent apertures to enable insulation to adhere to the sides of the structural framing members through the flanges, the insulation confining shield and application method enabling insulation to be applied prior to closing off either side of an unfinished wall or ceiling.

14 Claims, 9 Drawing Sheets

SPRAY INSULATION SHIELD APPARATUS AND APPLICATION METHOD

This application is a continuation-in-part of application Ser. No. 08/812,034 filed Mar. 6, 1997, now abandoned.

BACKGROUND OF THE INVENTION

The present invention relates generally to insulating open walls and ceilings in building structures, and more particularly, to an insulation confining shield for receiving insulation dispensed as curable liquid having a blowing agent or an insulation material with a curable adhesive, in an unfinished wall or ceiling, and which minimizes thermal losses through the framing structure.

It is well known in the art to utilize various types of insulating materials and methods for applying such materials to insulate a building structure. In the past, insulation materials have been supplied as rigid sheets, rolled strips or batts which were secured in position beneath the roof, above the ceiling, inside the walls or under the floor(s) of the structure.

To enable easier application of insulation to such areas, certain insulation materials have been applied under pressure through a nozzle, making the application process much easier and less costly. These materials are generally characterized as "blowable" or "blown" insulation, and comprise particulate or comminuted rock wool, cellulose or fiberglass, or a variety of particulate or comminuted forms.

Although such insulation materials are easier to apply to a building structure than the rigid sheet or strip types, they have several drawbacks. The particulate material has a tendency to settle, requiring an application to be continued until the density of the compact mass equals the settling density of the material. This requires that a cavity be defined for the blown insulation to be introduced into necessitating the backing surface to be installed prior to the insulation application process. In the case of an open attic, for example, it has been necessary for the installer to be located above the open framing structure for the ceiling. Furthermore, it was necessary to provide some kind of backing material to blow the insulation against. This backing material would have to be cut and formed around bracing, wiring, plumbing, etc., making for a labor-intensive process. Alternatively, it would be necessary for a contractor to install a drywall ceiling or wall prior to the application of insulation to provide a surface to spray against. This practice limits construction scheduling options as it is necessary for workers who are installing the roofing or walls to do so prior to the application of the insulation and to return again afterwards to complete the job.

A prior art insulation confining panel and method which enables blown insulation to be installed between a floor, wall, or ceiling is taught in U.S. Pat. No. 4,292,777 to Story ("Story"). The Story patent discloses a rectangular cardboard sheet which has two parallel longitudinal scores dividing the sheet into a pair of rectangular bendable margins joined by a sheet central portion. The width of the sheet central portion is substantially the same as the distance between adjacent floor or ceiling joints of a building structure. The longitudinal sheet margins have transverse slots dividing the margins into rows of separate tabs. These tabs are secured to adjacentjoints such that the sheet central portion extends between the joints to form a tray for holding a layer of blowable insulation material against the ceiling or floor. A plurality of air vents are disposed in the sheet central portion to enable air to escape when blowable insulation is inserted between the sheet central portion and an adjacent surface such as a floor or wall. The vents are sized to prevent any insulation from escaping the tray during installation. In using the Story confining panel, blowable insulation is inserted to holes defined in either of the floor or ceiling such that the insulation fills the space therebetween after the floor or ceiling has already been installed. As briefly discussed above, the blown particulate insulation materials are susceptible to settling, thereby requiring a confined area into which the materials are introduced. Accordingly, the Story patent does not teach application of a blowable insulation against a confining panel in an open wall or floor prior to installation of the floor or wall material. Furthermore, Story does not teach a way of applying blowable insulation against the confining panel in an open wall or ceiling in a manner that prevents unwanted heat transfer through the structural framing on the sides of such framing opposite to the side of insulation application, for example, the top surfaces of the ceiling joints in an open ceiling. The configuration of the Story panel does not allow insulation to migrate through the vents to seal the framing structures. The vents are situated such that insulation passing through the vents would not come into contact with the framing members preventing unwanted heat transfer.

These blown particulate insulation materials have settling characteristics such that their thickness and consequent R-value is substantially reduced over the originally applied amount. For this reason, the confining panel in Story is a horizontal tray which acts to define a chamber with the installed adjacent ceiling or floor structure into which the blowable insulation is applied until a compact mass of such insulation fills the space. The blowing application is maintained until the density of the compact mass confined by the panel and the wall or floor is at least equal to the settling density of that material. In this regard, the ventilation apertures in the central sheet portion of the confining panel enable air to escape the confined space into which the insulation is applied. The blown insulation is applied under substantial pressure, e.g., about 3.5 psi.

The Story structure and method of application, however, does not teach the application of a spray insulation material dispensed as a curable liquid or an insulation material with a curable adhesive, having sufficient viscosity to allow the material to adhere to the underlying surface, even under its own weight. An example of such a material is marketed under the name INSEALATION, available from Icynene, Inc. Such components are typically comprised of soft, white polyicyene foam, that is chemically related to a pillow or upholstery foam. It is sprayed into the spaces between the structural members of walls, adheres to virtually all building materials, and flows through voids, cracks and crevices. This material eliminates the need to have a confining chamber defined around the volume of applied insulation. Other materials include those with a curable adhesive such as cellulose or fiberglass mixed with an appropriate adhesive agent that cures after the material is applied to a suitable surface.

Other prior art patents directed to the use of channel-like barriers in walls, floors or ceilings to facilitate the application of insulation are shown in U.S. Pat. No. 2,788,552 to Miles ("Miles"), which shows a vapor barrier for hollow walls that is placed into an existing wall between the studs thereof, and then filled with an insulating material.

U.S. Pat. No. 3,619,437 to McDonald ("McDonald") teaches a spray insulation applied to the cavities between joints of a ceiling using a foraminous material through which the insulation is sprayed to capture the insulation from below. Specifically, the method entails installing the joints, placing the foraminous material over the joints and then securing it with clips. A flat, rigid material such as a plywood sheet is then placed over the joints and clips, the spray insulation is then sprayed between the burlap, which coalesces within the cavity defined between the burlap and the plywood sheet.

U.S. Pat. No. 3,160,987 to Pinkley ("Pinkley") teaches an insulation dam to prevent blown particulate insulation from clogging vents located in the eaves of a structure. Pinkley does not secure the dam to the top plate of the structure. The dam in Pinkley is only secured to the roof rafters. There are no spacing means to prevent installation of the dam in a manner which completely seals the eave. Because the dam is only secured to the rafters and not the top plate of the structure if the insulation is installed with sufficient pressure it will force flap 27 open, filling the eave with insulation. As briefly discussed above, blown particulate insulation materials are susceptible to settling, thereby requiring a confined area into which the materials are introduced. Accordingly, the Pinkley patent does not teach application of a blowable insulation against a confining panel in an open wall or floor prior to installation of the ceiling material. The ceiling 23 must be in place to utilize the Pinkley invention. Furthermore, Pinkley cannot be used when there is a large space between the top plate and the roof rafters. There is no height adjustment to allow the Pinkley dam to fit in structures other than those where the roof rafters rest on the top plate.

U.S. Pat. No. 4,189,870 to Fitzgerald ("Fitzgerald") teaches an insulation dam for use in the eaves of a structure which overcome some of the disadvantages of Pinkley described above. In Fitzgerald the dam is secured to the roof rafters at both ends. There are no supports along the length of the dam because there are flanges which keep the dam spaced from the roof sheeting insuring a path for air to flow. Over time the lack of support along the length of the dam will allow the dam to sag, compressing the insulation. The Fitzgerald dam, like the Pinkley dam can only be used when the ceiling is already installed. The Fitzgerald dam also lacks a height adjustment. As the space between the top plate and the roof rafters increase the Fitzgerald dam has no way to adjust to meet the greater height requirement.

While the advantages of using spray insulation which is dispensed as a curable liquid with a blowing agent or an insulation material with a curable adhesive are known, it has still been necessary for a backing surface to be installed prior to the insulation application. The present invention facilitates the insulation installation in open walls or ceilings enabling the insulation process to be completed prior to covering the ceilings or walls or where they are to remain open.

SUMMARY OF THE INVENTION

In view of the above described shortcomings in the prior art, it is an object of the present invention to provide an insulation confining shield which can be mounted between elongated structural framing members in an unfinished wall or ceiling to facilitate application of an insulation material dispensed as a curable liquid having a blowing agent or an insulation material with a curable adhesive against the insulation confining shield prior to installing any outer wall structure or panel.

It is a further object of the present invention to provide an insulation confining shield in accordance with the above which enables a quantity of curable liquid insulation material with a blowing agent or an insulation material with a curable adhesive to migrate through apertures formed in the shield such that such insulation adheres to an area outside of the shield on the structural framing members to reduce thermal losses attributable to heat transfer through the structural framing material.

It is yet another object of the present invention to provide a method for using an insulation confining shield in accordance with the above for applying insulation material dispensed as a curable liquid having a blowing agent or an insulation material with a curable adhesive to an unfinished wall or ceiling without having to have a backing panel or other structure in place prior to the insulation application.

It is still another object of the present invention to provide a method for using an insulation confining shield in accordance with the above for applying insulation material dispensed as a curable liquid material having a blowing agent or an insulation material with a curable adhesive to an unfinished wall or ceiling where the insulation migrates through the shield to adhere to an area outside of the shield on the structural framing members to reduce thermal losses attributable to heat transfer through the structural framing material.

In another embodiment of the invention, the shield is placed between the seal plate and the flooring in the area adjacent to the rim board of the building. The shield is sized so that it fits between the floor joists of the building. The shield defines a closed area which is filled with insulation to insulate the rim board of the building.

In accordance with the above objects and additional objects that will become apparent hereinafter, the present invention provides an insulation confining shield mountable between elongated structural framing members in an unfinished wall or ceiling for receiving insulation dispensed as curable liquid having a blowing agent or an insulation material with a curable adhesive, comprising: a sheet of elongated semi-rigid or rigid material having a center web section and a pair of opposed flanges extending substantially perpendicular from the center web section defining an insulation confining volume, the web section and the flanges being constructed and arranged to fit between the structural framing members in the wall or ceiling to retain insulation when applied against the web section and the flanges.

In one embodiment, the flanges have a plurality of vent apertures defined therethrough to enable a quantity of the insulation, when applied, to migrate from the insulation confining volume to an area outside of the confining volume and adhere to a portion of the structural framing members to mitigate heat transfer through the structural framing members. The vent apertures are linearly aligned along the flanges proximal to the web section of the shield. In a preferred embodiment, the vent apertures are about ¼ inch to ¾ inch wide, and spaced about ¼ inch to 1 inch apart.

In another embodiment, the shield contains enlarged vent apertures approximately 2 inches wide, and is placed relative to adjacent structural framing members such that applied insulation adheres to a portion of the sides of the framing members.

In yet another embodiment, the shield is placed between adjacent trusses between the top plate and roof sheeting in the area adjacent to the eave of a building. The insulation adheres to the shield keeping the soffit clear of insulation. The flange portion, which is attached to the roof sheeting, is shaped to act as a vent between the soffit and the attic. The vent allows air flow between the soffit vents and ridge vents. The shield is adjustable to accommodate structures where the roof rafters are not proximate to the top plate.

In a particular embodiment of the invention, in a wall or ceiling having a plurality of elongated structural framing members, each of the structural framing members having a first side and a second side in a widthwise direction, there is provided an insulation confining shield mounted between the structural framing members for receiving insulation dispensed as a curable liquid having a blowing agent or an insulation material with a curable adhesive prior to covering the wall or ceiling, comprising: a sheet of elongated semi-rigid or rigid material having a center web section and a pair of opposed flanges extending substantially perpendicular from the center web section defining an insulation confining volume, the web section and the flanges being constructed and arranged to fit between and to be attached to the structural framing members in the wall or ceiling to retain insulation when applied against the web section and the flanges, the shield being positioned such that a portion of each of the flanges extends beyond one of the first and second sides of the structural framing members, the flanges having a plurality of vent apertures defined therethrough to enable a quantity of the insulation, when applied, to migrate from the insulation confining volume to an area outside of the channel and adhere to a portion of the structural framing members to mitigate heat transfer through the structural framing members, the vent apertures being located along the flanges in an area thereof defined beyond the one of the first and second sides of the structural framing members.

In accordance with the above, there is also provided a method for applying insulation dispensed as a curable liquid having a blowing agent or an insulation material with a curable adhesive to the spaces between a plurality of structural framing members in a wall or ceiling with an insulation confining shield, the shield comprising a sheet of elongated semi-rigid or rigid material having a center web section and a pair of opposed flanges extending substantially perpendicular from the center web section defining an insulation confining volume, the web section and the flanges being constructed and arranged to fit between the structural framing members in the wall or ceiling to retain insulation when applied against the web section and the flanges, comprising the steps of:

(a) placing the shield between two adjacent structural framing members in the wall or ceiling;

(b) attaching the flanges of the shield to the two adjacent structural framing members, respectively, with a means for fastening the flanges to the structural framing members; and (c) spraying insulation displaced as a curable liquid having a blowing agent or an insulation material with a curable adhesive against the confining volume under a suitable pressure and in a quantity sufficient to fill the confining volume to a desired amount.

In accordance with the above, there is further provided a method for applying insulation or an insulation material with a curable adhesive dispensed as a curable liquid having a blowing agent to the spaces between a plurality of structural framing members in a wall or ceiling with an insulation confining shield, the shield comprising a sheet of elongated semi-rigid material having a center web section and a pair of opposed flanges extending substantially perpendicular from the center web section defining an insulation confining volume, the web section and the flanges being constructed and arranged to fit between the structural framing members in the wall or ceiling to retain insulation when applied against the web section and the flanges, the flanges having a plurality of vent apertures defined therethrough, comprising the steps of:

(a) placing the shield between two adjacent structural framing members in the wall or ceiling such that the vent apertures in the flanges are unobstructed by the structural framing members to communicate the confining volume with an area outside of the confining volume;

(b) attaching the flanges of the shield to the two adjacent structural framing members, respectively, with a means for fastening the flanges to the structural framing members; and (c) spraying insulation dispensed as a curable liquid having a blowing agent or an insulation material with a curable adhesive against the confining volume under a suitable pressure and in a quantity sufficient to fill the confining volume to a desired amount and to cause a quantity of insulation to pass through the vent apertures in the flanges and adhere to an area of the structural framing members outside of the confining volume.

The many advantages of the present invention will best be understood with particular reference to the detailed description below and accompanying drawings.

DETAILED DESCRIPTION OF THE PREFERRED EMBODIMENTS

Figure 2:
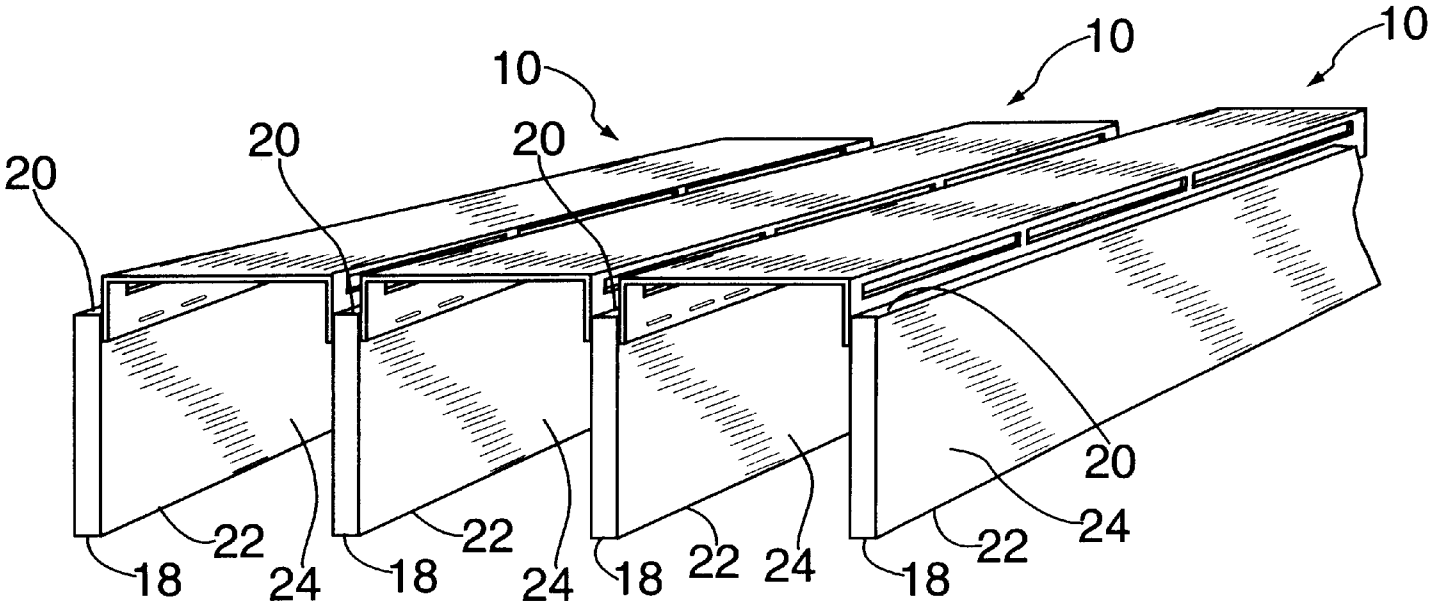
FIG. 2 is an isometric view of several insulation confining shields placed between adjacent framing members of a ceiling.

Referring now to the several views of the drawings, there is depicted an insulation confining shield generally characterized by the reference numeral 10 mounted in a representative framing structure of a ceiling and various phases of construction thereof. The insulation confining shield 10 is fabricated from a sheet of elongated semi-rigid or rigid material having a center web section 12 and a pair of opposed flanges 14 extending substantially perpendicular from the center web section 12 to define an insulation confining volume 16 on the flanged sides as shown. The web section 12 and flanges 14 are constructed and arranged to fit between the structural framing members 18 of a wall or ceiling as shown in FIG. 2. The insulation confining shield 10 can be fabricated out of a number of different materials, including but not limited to cardboard, wood, plastic, foam, honeycomb cardboard and the like. The choice of material may be dependent upon selection of an appropriate R-value for the intended application to minimize heat transfer through the assembly. The dimensions of the insulation confining shield 10 will vary depending upon the spacing of the structural framing members 18. In an exemplary application where the framing members 18 are 16" on center, the web portion 12 of the shield 10 should be approximately 14½" wide, and the flanges 14 approximately 3" deep. If the framing members 18 are spaced 24" on center, the web portion 12 of the shield 10 should be approximately 22½". The dimensions of the shield 10 can be selected to work with any framing configuration.

Figure 1:
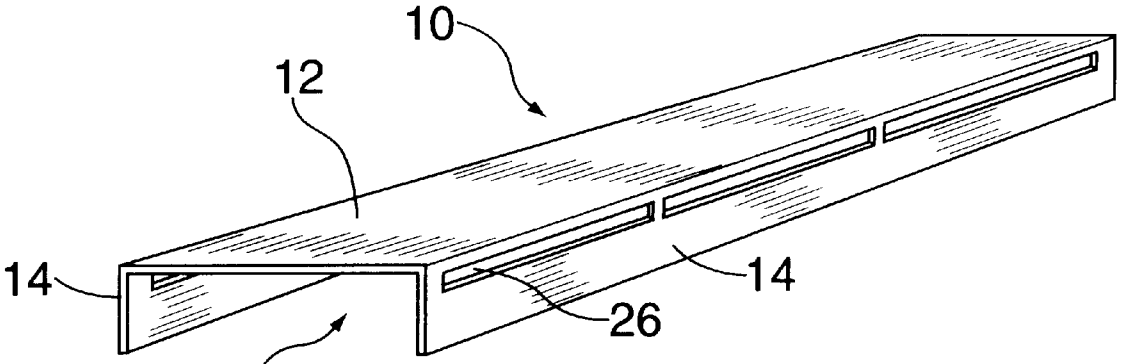
FIG. 1 is an isometric view of an insulation confining shield in accordance with the present invention.

One particular feature of the present invention is the application of the insulation material to one side of the insulation confining volume 16, where a quantity of insulation migrates through appropriately sized vent apertures in the shield 10 to the opposite side thereof and adheres to a portion of the structural framing members 18 to reduce thermal losses attributable to heat transfer through the structural framing members 18. In this connection, each structural framing member 18 has a first side 20 and generally smaller widthwise second side 22, and an elongated third side 24 and opposite fourth side 24. The insulation confining shield 10 is positioned between the framing members 18 such that a portion of the flange 14 extends above the first side 20 of framing members 18 as shown in FIGS. 2–7. A plurality of vent apertures 26 are defined in flanges 14 and linearly aligned along flanges 14 proximal to web section 12 as best illustrated in FIG. 1 The vent apertures 26 enable a quantity of insulation to flow from the insulation confining volume 16 to the area between adjacent insulation confining shields 10 and above first side 20 of structural framing member 18. In a preferred embodiment, the vent apertures are about ¼" to ¾" wide by approximately 12" long. They are spaced approximately ¼" to 2" apart depending upon the application.

Figure 3:
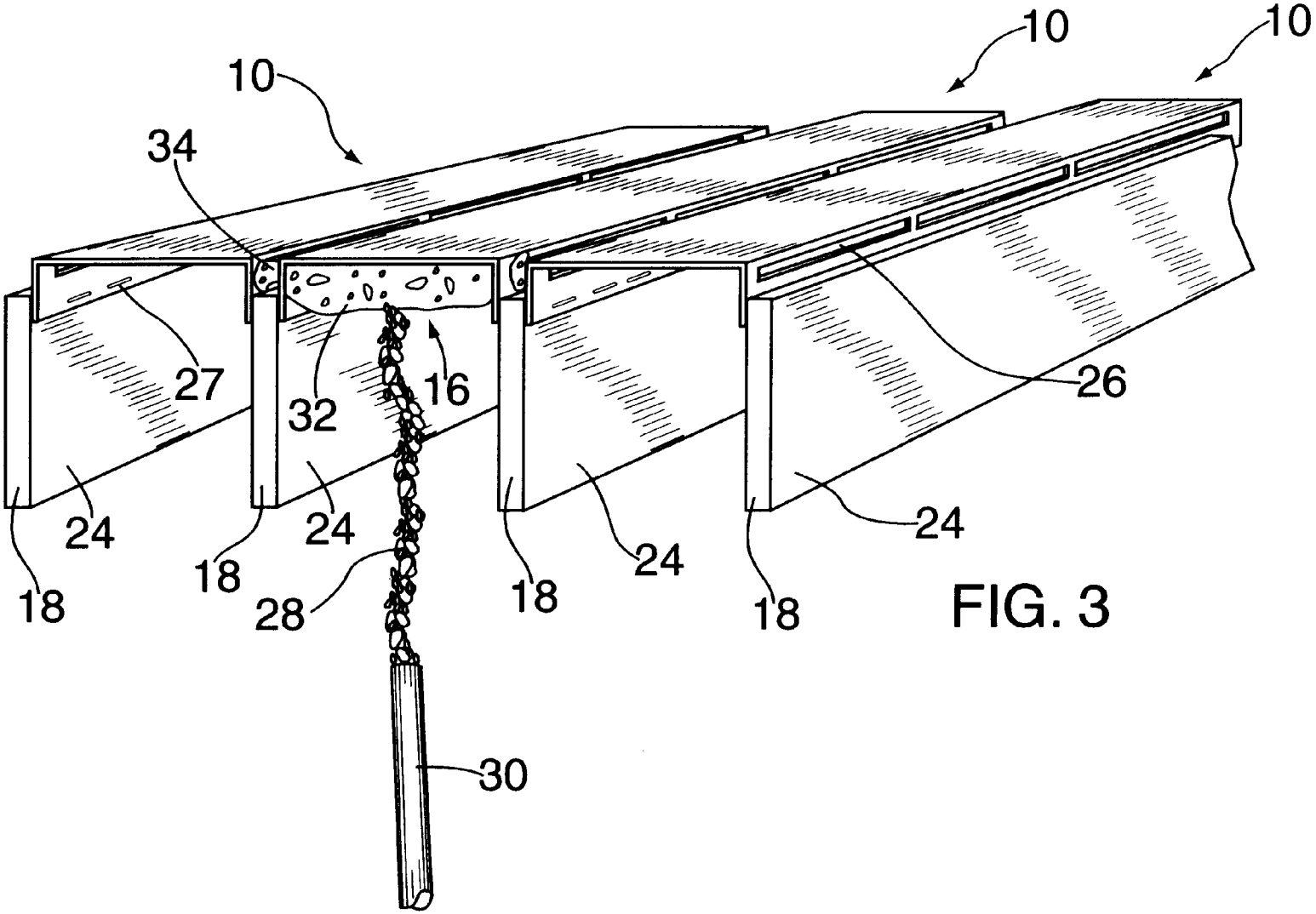
FIG. 3 is an isometric view of insulation being applied to the assembly of FIG. 2.
Figure 4:
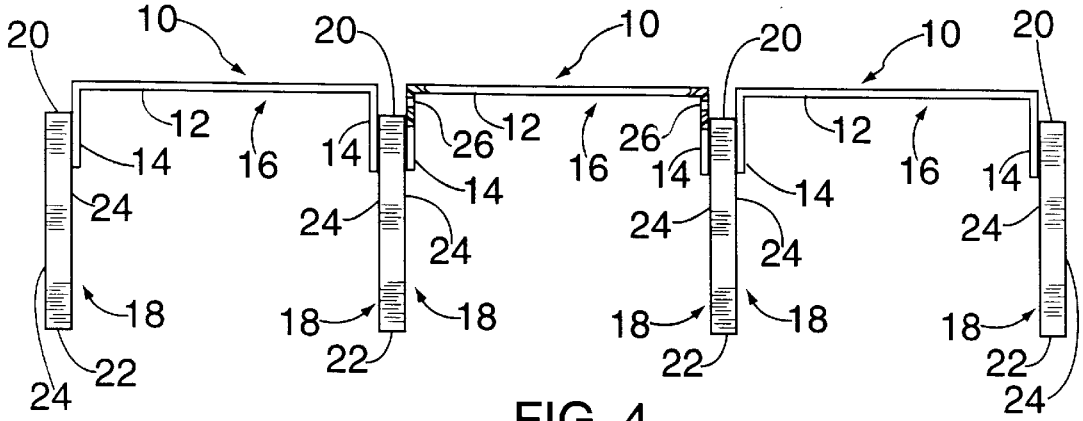
FIG. 4 is a front elevational view of the assembly of FIG. 2.
Figure 5:
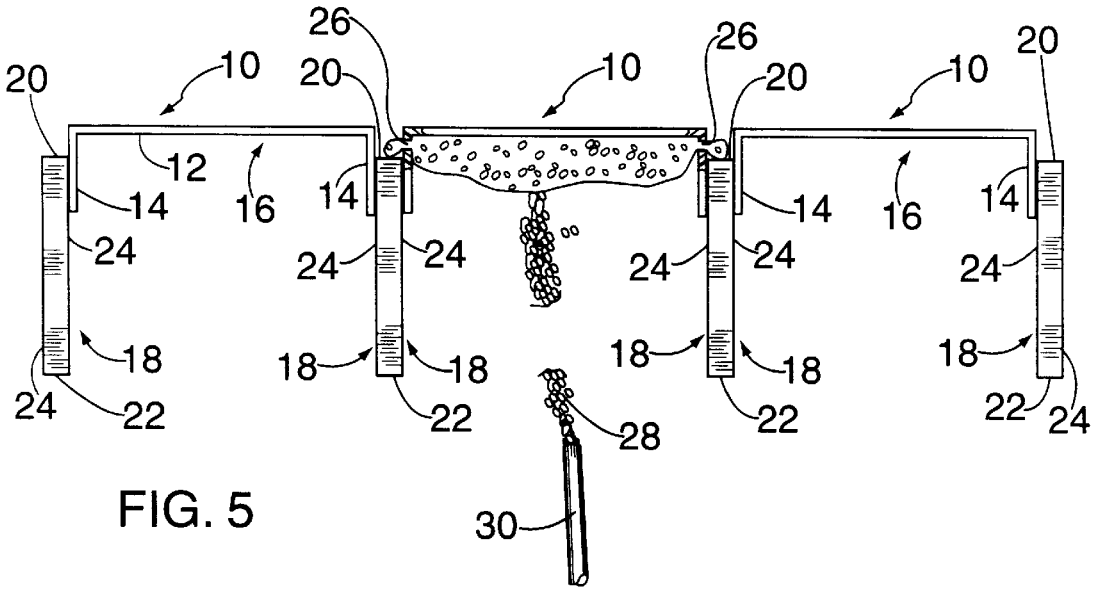
FIG. 5 is a front elevational view of the insulation application shown in FIG. 3.
Figure 6:
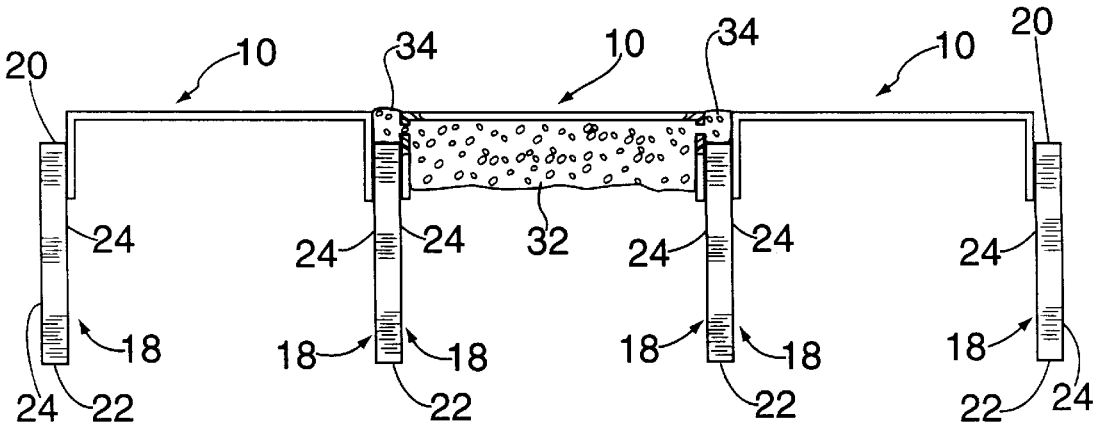
FIG. 6 is a front elevational view of the insulation application shown in FIG. 5 completed with insulation material located inside the confining volume of the shield and above the framing members.

Referring to FIG. 2, a plurality of insulation confining shields 10 are fastened to adjacent framing members 18 with a plurality of fasteners such as staples 27. The insulation confining panels 10 may alternatively be attached with nails, screws or like mechanical fasteners, and/or with adhesives if desired. After the insulation confining panels 10 are mounted in place, the insulation material may then be applied without the need to have a drywall or other backing surface attached to the structural framing members 18. As shown in FIGS. 3, 5 and 6, an insulation material 28 is dispensed from an applicator nozzle 30 into the confining volume 16 of the insulation confining shield 10. A quantity of insulation 32 collects in the insulation confining volume 16 while an amount of insulation 34 passes through the vent apertures 26 and into the space above the respective first sides 20 of the framing members 18 as shown. As described in the Background of the Invention, the insulation used in connection with the present invention is dispensed as a curable liquid having a blowing agent or an insulation material with a curable adhesive having sufficient viscosity to enable the material to adhere to the underlying surface to which it is applied, even when subjected to its own weight. This permits the insulation to be applied to a ceiling structure from below, obviating the prior art practice of attaching a tray or other backing surface to the ceiling framing and installing the insulation from above.

An example of a foam-like material suitable for use with the present invention is marketed under the name INSEALATION, available from Icynene, Inc. This material is typically comprised of soft, white polyicyene microcellular expanding foam, that is chemically related to a pillow or upholstery foam. It flows smoothly under pressure as a liquid, and includes a blowing agent that causes the foaming action to start after it is dispensed from nozzle 30 and exposed to air thereby curing into a dry material. Similarly, an insulation material such as cellulose or fiberglass with a curable adhesive may be dispensed from nozzle 30. FIG. 6 depicts a finished application of insulation between two contiguous structural framing members 18 where a desired thickness of insulation 32 adheres to a single insulation confining shield 10 and a smaller amount of insulation has migrated through the vent apertures 26 into the spaces above first side 20 of the respective framing members 18.

Figure 7:
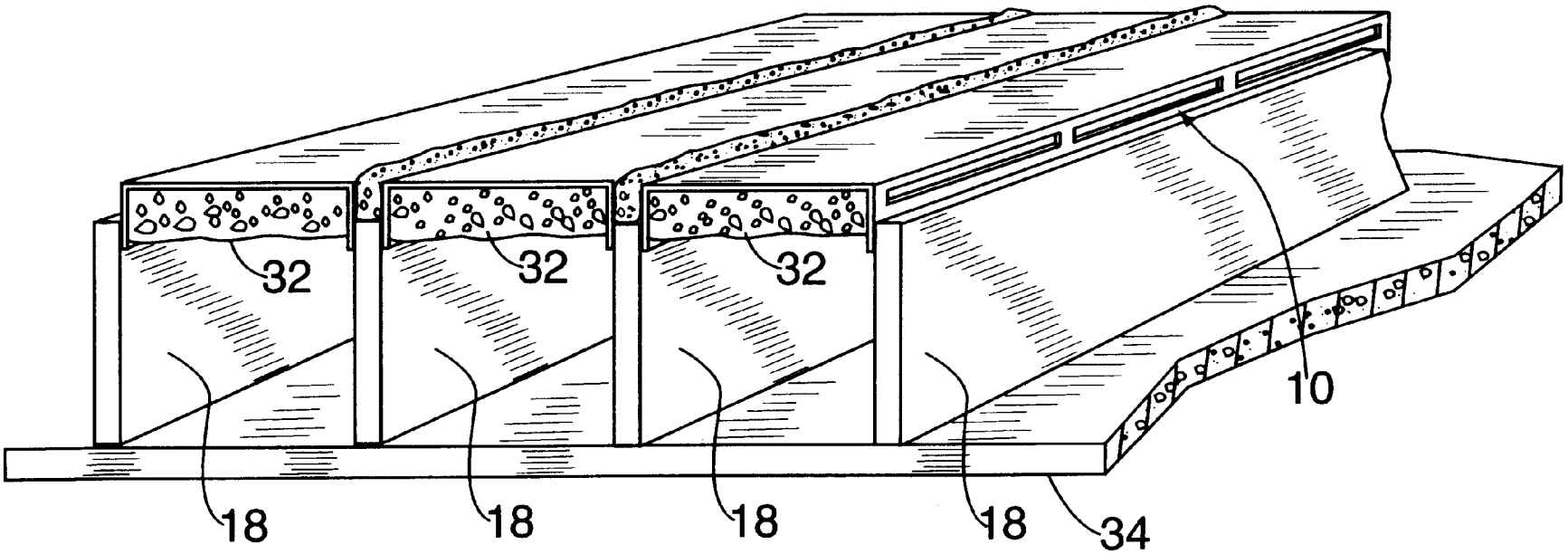
FIG. 7 is an isometric view of a finished ceiling assembly.

Referring now to FIG. 7, there is shown a partial sectional view of a completed ceiling assembly in which a quantity of insulation has been applied to each of the spaces between the adjacent framing members 18. A drywall ceiling 34 is attached to the structural framing members 18 from below.

Figure 8:
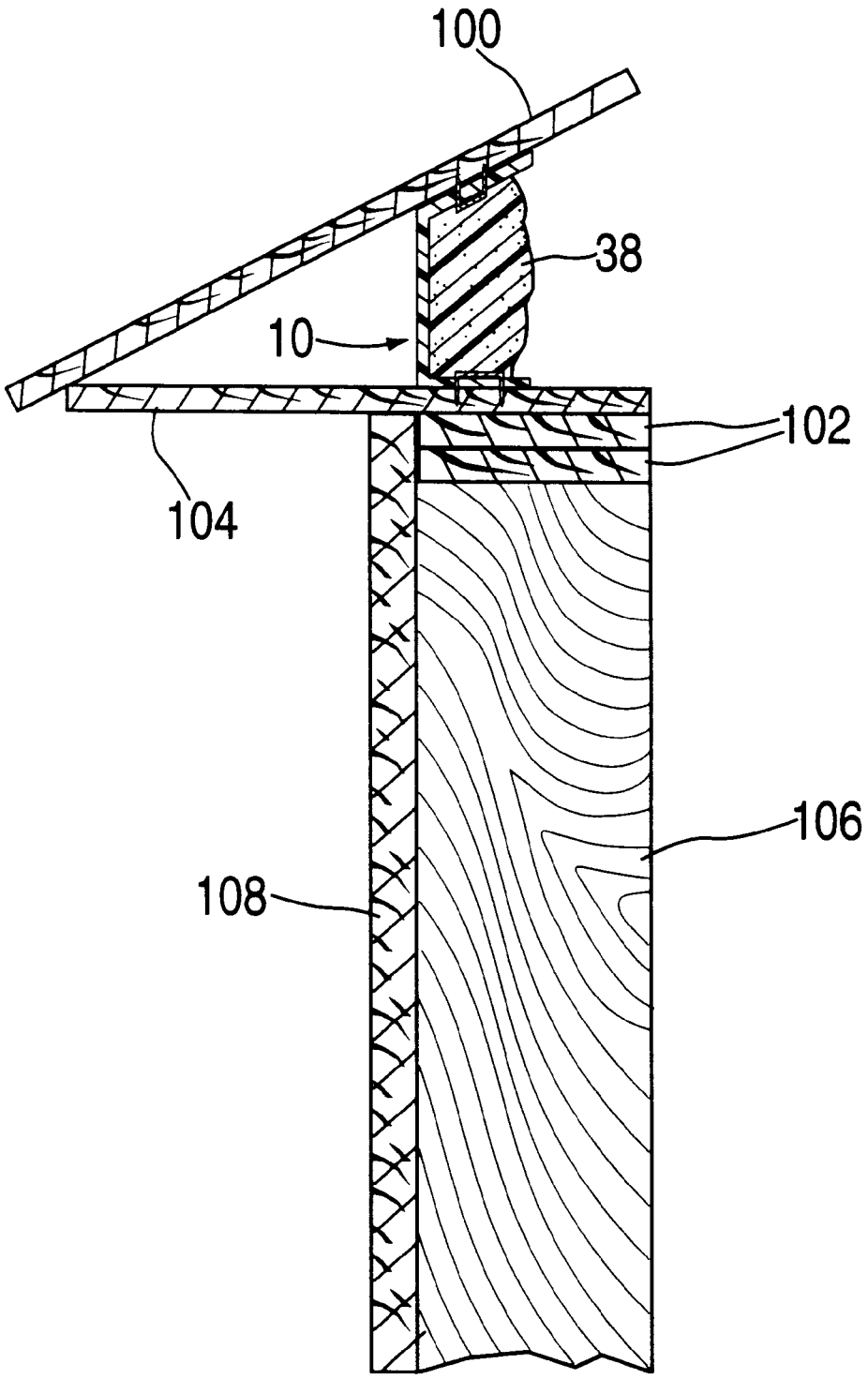
FIG. 8 is a sectional view of another embodiment for insulating the area adjacent to the eave of a building.

Referring now to FIG. 8, there is shown another embodiment wherein an insulation confining shield 10 is attached to the roof sheeting 100 and top plates 102 near the eave 104 of a building. In this application, a plurality of insulation confining shields 10 may be placed between adjacent trusses (not shown). The shields 10 may contain intermittently spaced vent apertures in the web section 12 thereof to enable air from the attic to escape to the eave venting (not shown). The venting of the attic reduces the possibility of moisture damage from condensation. The top plates 102 are supported by representative structural framing member 106. An outer wall 108 is attached to framing members 106 in a conventional manner. Insulation 38 is applied against the insulation confining shield 10 in the same manner as with the other embodiments described above.

Figure 8A:
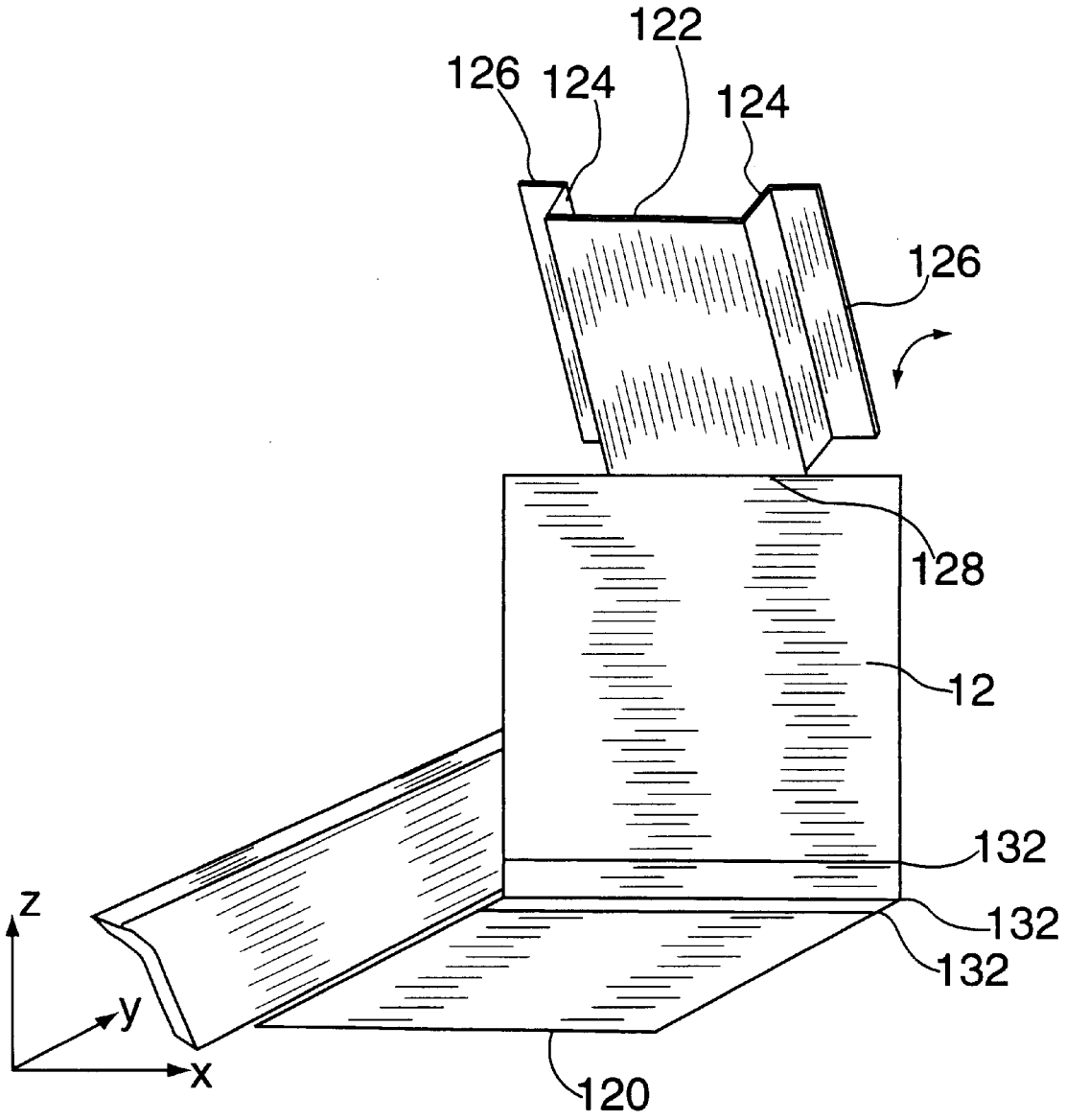
FIG. 8*a* is an isometric view of the shield in FIG. 8.

Referring to FIG. 8*a* the heel flange 120 of the shield is attached to the top plate 102 (not shown). The heel flange 120 and web portion 12 are designed to be adjustable to fit between the structural framing members of the building. Standard sizes would accommodate 16" and 24" on center framing. When installed, the web portion 12 of the shield is substantially perpendicular to the heel flange 120 of the shield. A second flange comprises the chute section 122, opposite the heel flange 120. The chute section 122 is scored in four places to facilitate forming the chute. The chute 122 is formed by folding the chute height flanges 124 about the z-axis in the y-direction. The outermost flanges, the mounting flanges 126 are folded about the z-axis until they are substantially perpendicular to the height flanges, generally "L" shaped. The vent portion of the shield is adjustable about score line 128 in the direction of the double arrow as shown. The chute section 122 is adjustable accommodate different pitch roofs. The chute 122 is adjusted until it is parallel to the roof sheeting 100 (not shown). The height of the web portion is also adjustable to accommodate different styles of trusses and rafters. The shield is scored in several parallel locations 132 to vary the size of the heel flange and web portion. As more height is required in the web portion 12 the size of the heel flange 120 is reduced. The vent and heel flanges can be secured using staples, nails screws, adhesives or the like. The vent is secured along the flanges preventing the chute from sagging over time. Once the shield is installed it acts as a form for the insulation to be sprayed against. The shield prevents the insulation from filling the soffits of the building. The vent portion of the shield allows air to flow from the soffit vents (not shown) to the ridge vents (not shown) reducing problems due to moisture in the attic once the insulation is installed.

Figure 9:
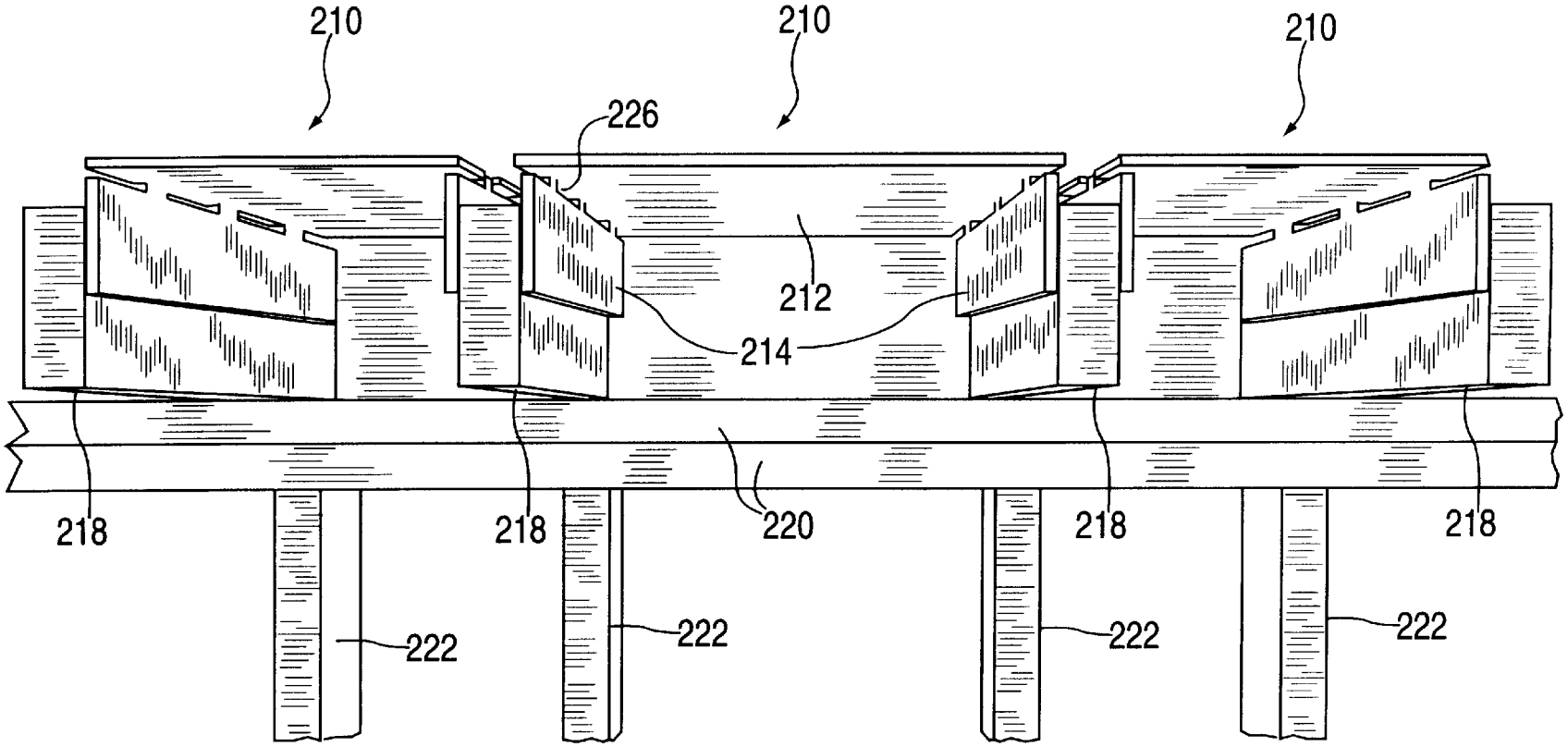
FIG. 9 is an isometric view of another shield embodiment wherein the vent apertures are formed by notching the interface between the web and flanges.

Referring now to FIG. 9, there is depicted another insulation confining shield 210 having a center web section 212 and a pair of opposed flanges 214. A plurality of vent apertures 226 are defined by notching the shield material and then folding the flanges 214 from the center web section 212 as shown. This arrangement allows for ease of fabrication and eliminates having to form the vent apertures 226 in a separate operation. The insulation confining shields 210 are shown in an open ceiling application attached to a plurality of adjacent structural framing members 218, that are supported by top plates 220 and a plurality of vertical studs 222.

Figure 10:
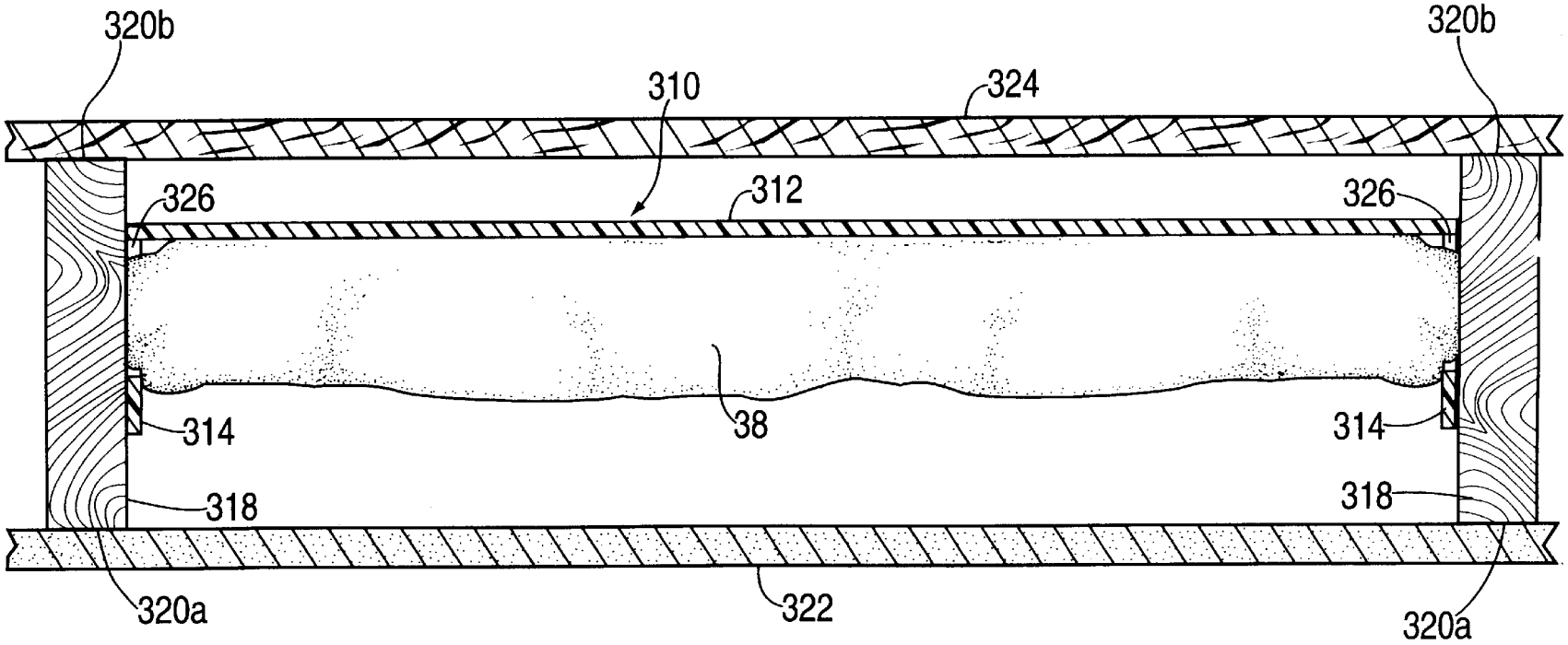
FIG. 10 is a sectional view of a shield having enlarged vent apertures placed midway along the structural framing members.

Referring now to FIG. 10, there is depicted yet another embodiment, in which an insulation confining shield 310 is configured and placed entirely within the width of structural framing members 318. In this regard, the web section 312 and flanges 314 are sized to enable the shield 310 to fit intermediate the edges 320*a*, 320*b* of structural framing members 318 as shown. A plurality of vent apertures 326 are defined in the respective flanges 314 and sized to enable a quantity of insulation 38 to adhere to a portion of the structural framing members as shown. In this embodiment, the vent apertures 326 are larger than in the other configurations, with a preferable size being about 2" wide× 12" long. After the insulation 38 is applied, the front wall 322 and rear wall 324 are installed to form a closed wall as shown in FIG. 10. The same arrangement may be employed in a ceiling, with one wall omitted if desired, similar to the other embodiments.

It is also anticipated that the insulation confining shield could be mounted with the web section 12 flush with top surface 20 of the framing members 18. In an application where it is unnecessary to insulate the spaces above the framing members 18, the vent apertures 26 may be eliminated. This may be employed in finished walls where both sides are to be covered with drywall, but where it is desired to install the insulation prior to finishing construction of the wall. Thus, an insulator can simply fasten a plurality of insulation confining shields 10 to the framing members 18 of the open walls or ceilings and then complete the entire insulation job before the labor installs the drywall.

Figure 11:
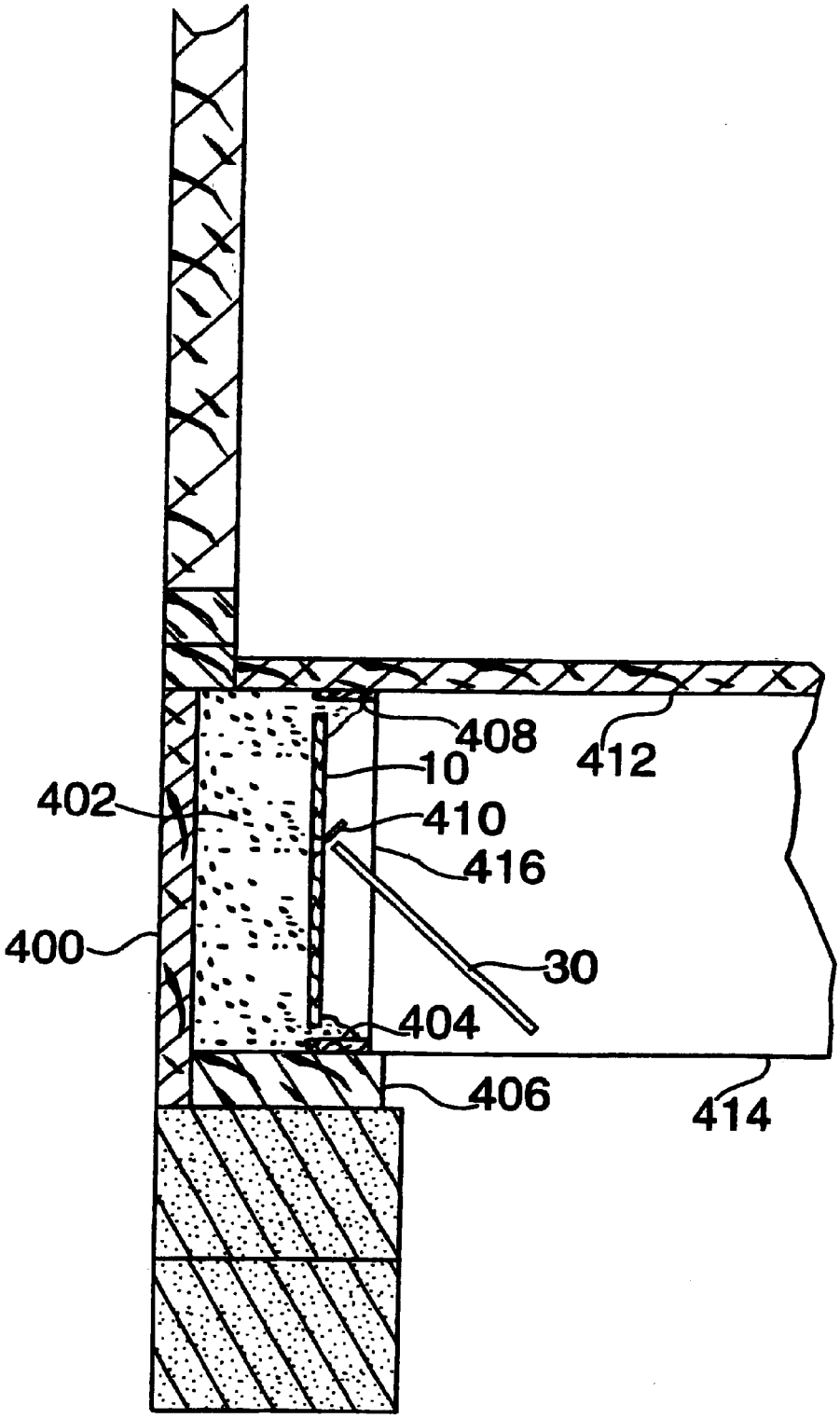
FIG. 11 is a sectional view of another embodiment of the invention for insulating the area adjacent to the rim stop of a building.

In another embodiment of the as shown in FIG. 11, the shield 10 is used to provide a chamber 402 which can be filled with insulation to insulate the rim board 400 in the basement of a building. The shield 10 is designed to fit between the floor joists 414 of a building. The shield is perforated to allow the installer to easily fold the shield to the correct size. The perforations allow the shield to be used with floor joists which are 2×10, 2×12, or I type joists. The heel portion 404 of the shield attaches to the seal plate 406 of the building. The shield is attached using staple, nails, screws or the like. The side flanges 416 are folded and attached to the floor joists. The end flange 408 is then folded and attached to the flooring 412. The web portion of the shield has a centrally located circular cut. The cut is an arc of approximately 270°, one inch in diameter. The cut defines a hole which serves as an insulation insertion point and a flap 410 to close the hole. The hole is sized to allow an insulation installation tool 30 to pass through the shield 10. Once the chamber 402 created by the shield 10 is filled to the desired density with insulation, the insulation installation tool 30 is removed and the flap 410 is used to seal the hole.

In accordance with the foregoing, the present invention provides a method for applying insulation 28 dispensed as a curable liquid having a blowing agent or an insulation material with a curable adhesive to the spaces between a plurality of structural framing members 18 in a wall or ceiling with an insulation confining shield 10, wherein the shield comprises a sheet of elongated semi-rigid or rigid material having a center web section 12 and a pair of opposed flanges 14 extending substantially perpendicular from the center web section 12 defining an insulation confining volume 16, the web section 12 and the flanges 14 being constructed and arranged to fit between the structural framing members 18 in the wall or ceiling to retain insulation 28 when applied against the web section 12 and the flanges 14, comprising the steps of:

(a) placing the shield 10 between two adjacent structural framing members 18 in the wall or ceiling;

(b) attaching the flanges 14 of the shield 10 to the adjacent structural framing members 18, respectively, with mechanical fasteners, adhesive or a combination thereof; and (c) spraying insulation 28 dispensed as a curable liquid having a blowing agent or insulation material with a curable adhesive into the confining volume 16 under a suitable pressure and in a quantity sufficient to fill the confining volume 16 to yield a desired thickness of insulation 28.

In accordance with the invention, in an alternative embodiment, a plurality of vent apertures 26 are defined in the flanges 14 and the spray insulation is dispensed in step (c) in a quantity sufficient to fill the confining volume 16 to a desired insulation thickness and to cause an amount of insulation to pass through the vent apertures 26 and adhere to the first sides 20 of the framing members in the spaces between the insulation confining shields 10 outside of the confining volume 16.

The present invention has been shown and described in what are considered to be the most practical and preferred embodiments. It is anticipated, however, that the departures may be made therefrom and that obvious modifications will be implemented by persons skilled in the art.

I claim:

1. An insulation confining shield mountable between elongated structural framing members in an unfinished wall or ceiling for insulation dispensed as curable liquid having a blowing agent or insulation material with a curable adhesive, comprising:

a sheet of elongated material having a center web section and a pair of opposed flanges extending substantially perpendicular from said center web section defining an insulation confining volume, said web section and said flanges being constructed and arranged to fit between the structural framing members in the wall or ceiling to retain said insulation when cured after being applied against said web section and said flanges, said flanges having a plurality of vent apertures defined therethrough to enable a quantity of said insulation, when applied, to migrate from said insulation confining volume to an area outside of said confining volume and adhere to a portion of the structural framing members to mitigate heat transfer through the structural framing members, wherein said vent apertures are a minimum of about 7/16 inch wide.

2. The insulation confining shield recited in claim 1, wherein said vent apertures are linearly aligned along said flanges proximal to said web section of said shield.

3. The insulation confining shield recited in claim 1, wherein said vent apertures are spaced about ¼ inch to 2 inches apart.

4. The insulation confining shield recited in claim 1, wherein said vent apertures are about 2 inches wide.

5. An insulation confining shield mountable between structural framing members in a wall or ceiling having a plurality of elongated structural framing members, each of said structural framing members having a first side and a second side in a widthwise direction, for receiving insulation dispensed as a curable liquid having a blowing agent or an insulation material with a curable adhesive prior to covering said wall or ceiling, comprising:

a sheet of elongated material having a center web section and a pair of opposed flanges extending substantially perpendicular from said center web section to form a channel, defining an insulation confining volume, said web section and said flanges being constructed and arranged to fit between and to be attachable to said structural framing members in the wall or ceiling to retain said insulation when applied against said web section and said flanges, said flanges having a plurality of vent apertures defined therethrough to enable a quantity of said insulation, when applied, to migrate from said insulation confining volume to an area outside of said channel and adhere to a portion of said structural framing members to mitigate heat transfer through said structural framing members, said vent apertures being located along said flanges, wherein said vent apertures are a minimum of about 7/16 inch wide.

6. A method for applying insulation dispensed as a curable liquid having a blowing agent or an insulation material with a curable adhesive to a plurality of spaces between a plurality of structural framing members in a wall or ceiling with an insulation confining shield, the shield comprising a sheet of elongated material having a center web section and a pair of opposed flanges extending substantially perpendicular from said center web section defining an insulation confining volume, said web section and said flanges being constructed and arranged to fit between the structural framing members in the wall or ceiling to form a confining volume and retain said insulation when applied against said web section and said flanges, comprising the steps of:

(a) placing said shield between two adjacent structural framing members in the wall or ceiling;

(b) attaching said flanges of said shield to said two adjacent structural framing members, respectively, with a means for fastening said flanges to said structural framing members to form said confining volume; and (c) spraying said insulation against said confining volume under a suitable pressure and in a quantity sufficient to fill said confining volume to a desired amount and an area of said structural framing members outside of said confining volume.

7. The method for applying insulation dispensed as a curable liquid having a blowing agent or an insulation material with a curable adhesive as recited in claim 6, further comprising the step of attaching a wall or ceiling panel to at least one side of said structural framing members after said insulation has been applied to said insulation confining volume.

8. A method for applying insulation dispensed as a curable liquid having a blowing agent or an insulation material with a curable adhesive to a plurality of spaces between a plurality of structural framing members in a wall or ceiling with an insulation confining shield, the shield comprising a sheet of elongated material having a center web section and a pair of opposed flanges extending substantially perpendicular from said center web section defining a blowable insulation confining volume, said web section and said flanges being constructed and arranged to fit between the structural framing members in the wall or ceiling to retain said insulation when applied against said web section and said flanges, said flanges having a plurality of vent apertures defined therethrough, wherein said vent apertures are a minimum of about 7/16 inch wide, comprising the steps of:

(a) placing said shield between two adjacent structural framing members in the wall or ceiling such that said vent apertures in said flanges are unobstructed by said structural framing members to communicate said confining volume with an area outside of said confining volume;

(b) attaching said flanges of said shield to said two adjacent structural framing members, respectively, with a means for fastening said flanges to said structural framing members; and (c) spraying said insulation against said confining volume under a suitable pressure and in a quantity sufficient to fill said confining volume to a desired amount and to cause a quantity of said insulation to pass through said vent apertures in said flanges and adhere to an area of said structural framing members outside of said confining volume.

9. A method for applying insulation dispensed as a curable liquid having a blowing agent or an insulation material with a curable adhesive to a plurality of spaces between a plurality of structural framing members adjacent to an eave of a building with an insulation confining shield, the shield comprising a sheet of elongated material having a center web section and a pair of opposed flanges, an upper and lower flange, extending from said center web section defining an insulation confining volume, said web section and said flanges being constructed and arranged to fit between the structural framing members to retain said insulation when applied against said web section, said upper flange forming a vent, comprising the steps of:

(a) placing said shield between two adjacent structural framing members and adjacent to the eave;

(b) attaching said flanges of said shield to a roof portion and a ceiling portion, respectively, with a means for fastening said flanges to said roof and said ceiling; and (c) spraying said insulation against said confining volume under a suitable pressure and in a quantity sufficient to fill said confining volume to a desired amount.

10. An insulation confining shield mountable to a roof deck and a top plate of a building between elongated structural framing members for insulation dispensed as a curable liquid having a blowing agent or an insulating material with curable adhesive, comprising:

a sheet of elongated semi-rigid material having a center web section and a pair of opposed flanges, a first flange extending substantially perpendicular to said shield to attach to said top plate, a second flange being adjustable to match the angle of said roof deck, said second flange being vertically scored in four places to facilitate folding said second flange into a pair of "L" shaped flanges comprised of a height member and a mounting member, a pair of outermost scores facilitate folding a pair of mounting members, a pair of innermost scores facilitate folding a pair of height members, said two opposing "L" shaped flanges which when folded form a vent, the outermost mounting members for attachment to said roof deck.

11. An insulation confining shield mountable to a top plate and flooring between elongated flooring joists, said insulation confining shield comprising a sheet of elongated semi-rigid material having a center web section and a plurality of perforations to facilitate forming two pairs of opposing flanges, first pair of flanges to be attached to said flooring joists, a first flange of said second pair of flanges to be attached to the top plate, a second flange of said second pair of flanges to be attached to said flooring, the central web portion having an arcuate slot, said slot defining a hole covered by a flap, the flap being moveable for the insertion of insulation after the shield is put in place, said insulation being able to migrate through said perforations, said flap sealing the hole once the insulation is installed.

12. The insulation confining shield recited in claim 11 wherein said plurality of perforations provide size adjustment to the center web and flanges assuring a perfect fit between said floor joists and between the top plate and flooring.

13. A method for applying insulation dispensed as a curable liquid having a blowing agent to a confined area defined by a space between floor joists, flooring, a top plate, and an insulation confining shield, the shield comprising a sheet of elongated material having a central web section, a pair of side flanges, and a pair of top and bottom flanges extending substantially perpendicular from said center web section, said web section and said side, top and bottom flanges constructed to fit between the floor joists, the flooring, and the top plate of a building, the central web section having a centrally located aperture for injecting said insulation and perforations where said central web section meet said pair of side flanges and said top and bottom flanges, comprising the steps of:

(a) placing the shield between two adjacent floor joists, adjacent to rim board;

(b) attaching said bottom flange, of said shield to the top plate of the building with a means for fastening said shield to said top plate;

(c) attaching the side flanges to said floor joists with a means for fastening said shield to said floor joists;

(d) attaching the top flange of said shield to the flooring with a means for fastening said shield to said flooring; and (e) spraying said insulation through said centrally located aperture, filling said confined area to a desired amount, said insulation migrating through said perforations.

14. The method of claim 13 further consisting of sealing said aperture after the desire amount of insulation is installed in said confined area.

* * * * *